US007441835B2

(12) United States Patent
Chen et al.

(10) Patent No.: US 7,441,835 B2
(45) Date of Patent: Oct. 28, 2008

(54) ANGLE-ADJUSTABLE BACKREST DEVICE FOR A CHILD HIGHCHAIR

(75) Inventors: Shun-Min Chen, Taipei (TW); Zhi-Ren Zhong, Taipei (TW)

(73) Assignee: Wonderland Nurserygoods Co., Ltd. (TW)

( * ) Notice: Subject to any disclaimer, the term of this patent is extended or adjusted under 35 U.S.C. 154(b) by 25 days.

(21) Appl. No.: 11/556,608

(22) Filed: Nov. 3, 2006

(65) Prior Publication Data

US 2007/0273191 A1 Nov. 29, 2007

(30) Foreign Application Priority Data

May 26, 2006 (CN) ..... 2006 2 0117621

(51) Int. Cl.
*A47C 1/02* (2006.01)
*A47C 4/00* (2006.01)

(52) U.S. Cl. ..... 297/16.1; 297/363; 297/364; 297/367

(58) Field of Classification Search ..... 297/16.1, 297/363, 364, 367
See application file for complete search history.

(56) References Cited

U.S. PATENT DOCUMENTS 5,482,311 A * 1/1996 Huang ..... 280/642
5,669,664 A * 9/1997 Perego ..... 297/327
5,687,985 A * 11/1997 Sack ..... 280/650
5,795,091 A * 8/1998 Kakuda et al. ..... 403/325
6,126,236 A * 10/2000 Wu ..... 297/325
6,361,106 B1 * 3/2002 Huang ..... 297/32
6,398,304 B1 * 6/2002 Chen et al. ..... 297/327
6,666,505 B2 12/2003 Greger et al.
7,066,542 B2 * 6/2006 Wang ..... 297/376
7,219,959 B2 * 5/2007 Ransil et al. ..... 297/277
2007/0096528 A1 * 5/2007 Nolan et al. ..... 297/363

* cited by examiner

*Primary Examiner*—Sarah B McPartlin
(74) *Attorney, Agent, or Firm*—Ostrolenk, Faber, Gerb & Soffen, LLP

(57) ABSTRACT

An angle-adjustable backrest device includes a backrest frame and an angle-adjusting device for connecting the backrest frame to a chair. The angle-adjusting device includes a mounting seat mounted on a leg frame and provided with positioning components, and a pivot seat mounted on a seat, connected to the backrest frame, and pivoted to the mounting seat. A locking unit includes a slide member mounted slidably on the backrest frame and having a positioning groove to engage the selected positioning component to thereby lock the backrest frame at a desired angle relative to the leg frame, a biasing member for biasing the slide member to an engaging position, and an actuator unit operable to drive movement of the slide member from the engaging position to a disengaging position.

18 Claims, 9 Drawing Sheets

ANGLE-ADJUSTABLE BACKREST DEVICE FOR A CHILD HIGHCHAIR

CROSS-REFERENCE TO RELATED APPLICATION

This application claims priority of Chinese application no. 200620117621.9, filed on May 26, 2006.

BACKGROUND OF THE INVENTION

1. Field of the Invention

The invention relates to an angle-adjustable backrest device, more particularly to an angle-adjustable backrest device for a child highchair.

2. Description of the Related Art

U.S. Pat. No. 6,398,304 discloses a seat angle adjustment mechanism for connecting a seat to a leg frame and operable to adjust inclination of the seat relative to the leg frame. U.S. Pat. No. 6,666,505 discloses an angle-adjusting device for connecting a backrest to a seat member and operable to adjust inclination of the backrest relative to the seat member.

U.S. Pat. No. 5,687,985 discloses a reclining mechanism for connecting a backrest frame to a stroller frame and operable to adjust inclination of the backrest frame relative to a seat of the stroller frame.

SUMMARY OF THE INVENTION

The object of the present invention is to provide an angle-adjustable backrest device that can be applied to a child highchair, that has a relatively simple construction, and that is easy to operate.

Another object of the present invention is to provide an angle-adjustable backrest device that includes a footrest frame capable of pivoting with a backrest frame.

Accordingly, an angle-adjustable backrest device of the present invention is to be applied to a chair that includes a leg frame and a seat connected to the leg frame. The angle-adjustable backrest device comprises a backrest frame and an angle-adjusting device adapted for connecting the backrest frame to the chair. The angle-adjusting device includes a mounting seat, a pivot seat, and a locking unit.

The mounting seat is adapted for mounting on the leg frame, and has an inner side wall provided with a plurality of positioning components.

The pivot seat is adapted for mounting on the seat, is connected to the backrest frame, and is pivoted to the inner side wall of the mounting seat.

The locking unit includes a slide member, a biasing member, and an actuator unit. The slide member is mounted slidably on the backrest frame, and has one side formed with a positioning groove. The slide member is movable on the backrest frame from an engaging position, where the positioning groove engages a selected one of the positioning components on the mounting seat to lock the backrest frame at a desired angle relative to the leg frame, and a disengaging position, where the positioning groove is disengaged from the positioning components on the mounting seat to permit adjustment of the angle of the backrest frame relative to the leg frame. The biasing member biases the slide member to the engaging position. The actuator unit is connected to the slide member, and is operable to drive movement of the slide member from the engaging position to the disengaging position.

Preferably, the angle-adjustable backrest device further comprises a footrest frame disposed below the backrest frame, connected to the pivot seat, and pivotable together with the backrest frame and the pivot seat relative to the mounting seat.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
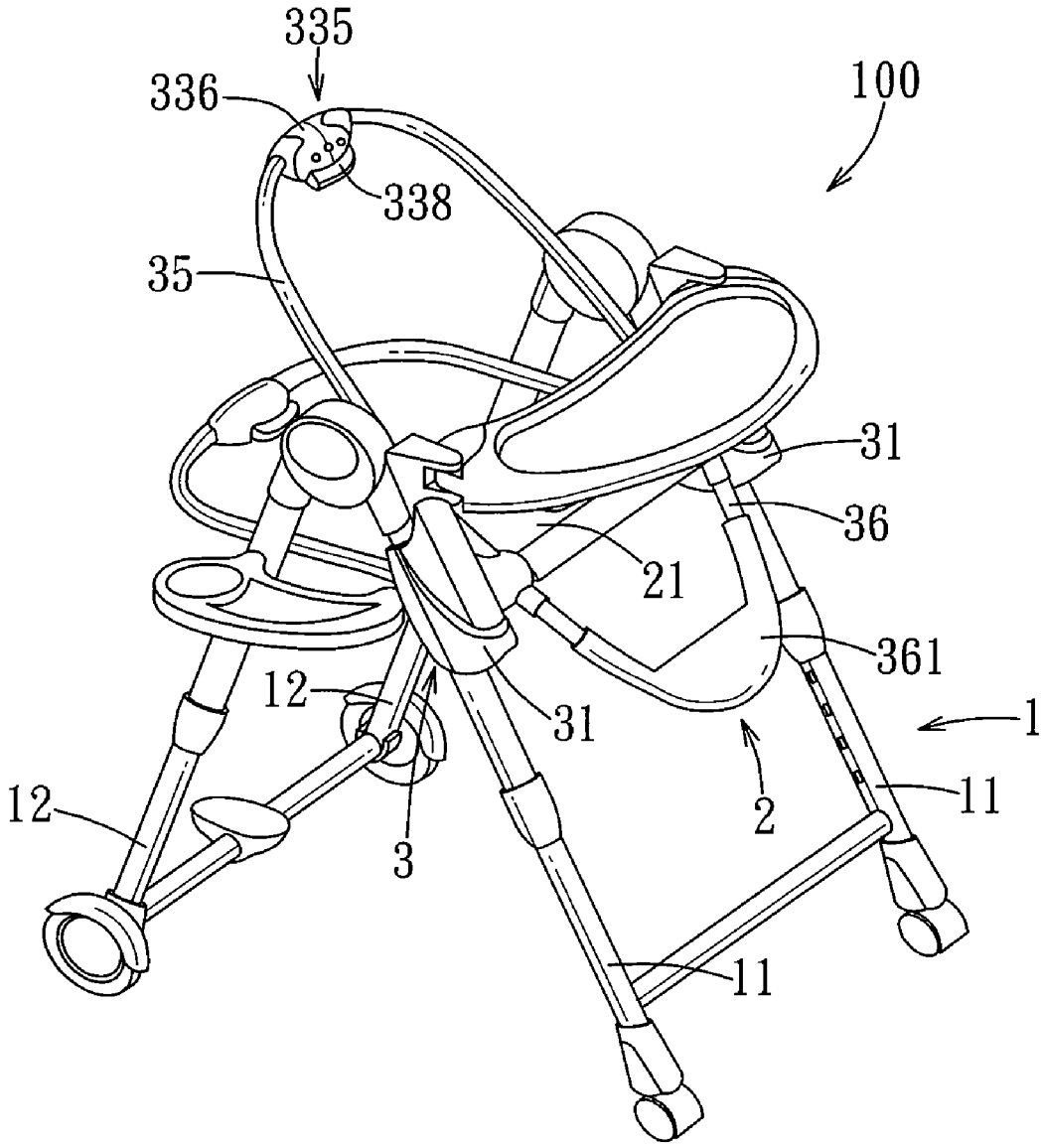
FIG. 1 is an assembled perspective view of a child highchair that incorporates the first preferred embodiment of an angle-adjustable backrest device according to the present invention.
Figure 2:
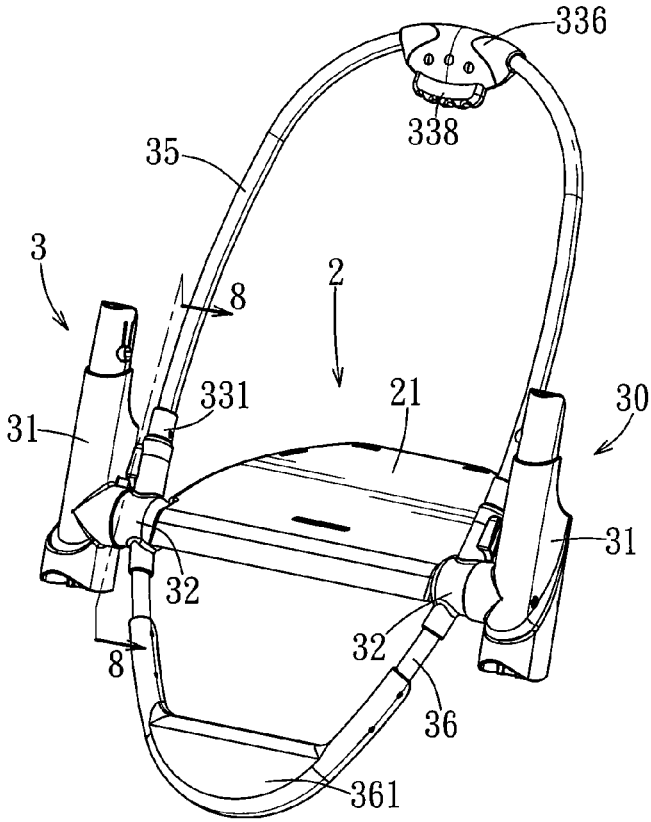
FIG. 2 is an assembled perspective view of the first preferred embodiment.
Figure 3:
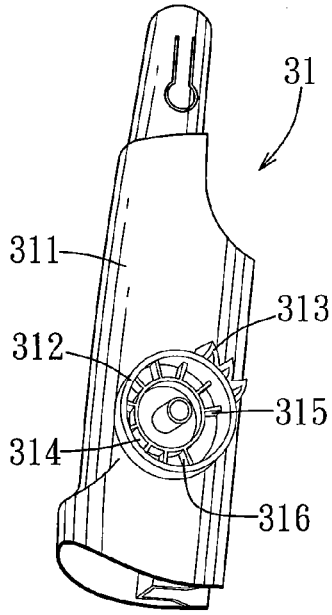
FIG. 3 is a perspective view to illustrate a mounting seat of the first preferred embodiment.

Before the present invention is described in greater detail with reference to the accompanying preferred embodiments, it should be noted herein that like elements are denoted by the same reference numerals throughout the disclosure.

Referring to FIGS. 1 to 4, the first preferred embodiment of an angle-adjustable backrest device 3 according to the present invention is shown to be applied to a child highchair 100 that includes a leg frame 1 and a seat 2 connected to the leg frame 1. The leg frame 1 includes a pair of front legs 11 that are spaced apart from each other and that have interconnected bottom ends, and a pair of rear legs 12 that are connected respectively and pivotally to top ends of the front legs 11 and that have interconnected bottom ends. The seat 2 includes a seat member 21 disposed between the front and rear leg pairs 11, 12. The angle-adjustable backrest device 3 includes a backrest frame 35, a footrest frame 36, and an angle-adjusting device 30 for connecting the backrest and footrest frames 35, 36 to the child highchair 100.

The backrest frame 35 is disposed above the seat member 21, and the footrest frame 36 is disposed below the seat member 21. In this embodiment, the backrest and footrest frames 35, 36 cooperate to define an oval-shaped frame divided by the seat member 21 into upper and lower parts (i.e., the backrest and footrest frames 35, 36). The angle formed by the oval-shaped frame relative to the front legs 11 can be adjusted through the angle-adjusting device 30.

In this embodiment, the angle-adjusting device 30 includes a pair of mounting seats 31, a pair of pivot seats 32, and a locking unit 33.

Each of the mounting seats 31 is made of plastic in this embodiment, is sleeved fixedly on a top end of a respective front leg 11 of the leg frame 1, and has an inner side wall 311 provided with a plurality of positioning components 313. Preferably, the mounting seat 31 includes a first annular sleeve 312 at the inner side wall 311, and the positioning components 313 are formed as adjacent teeth that project in radial outward directions from the first annular sleeve 312. The number of the positioning components 313 is three for each mounting seat 31 in this embodiment. Moreover, the first annular sleeve 312 of each mounting seat 31 has an inner sleeve surface 314 formed with first and second limit walls 315, 316 that extend in radial inward directions and that are spaced apart from each other by an angular distance.

Each of the pivot seats 32 is also made of plastic in this embodiment, is in the form of a cross-shaped coupler, and includes a second annular sleeve 321 mounted on a respective lateral edge of the seat member 21 and having a diameter smaller than that of the first annular sleeve 312. As such, the first annular sleeve 312 of each mounting seat 31 can be sleeved rotatably on the second annular sleeve 321 of a corresponding pivot seat 32 such that the pivot seat 32 is pivoted to the corresponding mounting seat 31. Each pivot seat 32 further includes two connecting sleeves 322 that extend outwardly in upward and downward directions from the second annular sleeve 321 for connecting to the backrest frame 35 and the footrest frame 36, respectively. In this embodiment, the second annular sleeve 321 of each pivot seat 32 has an inner sleeve surface provided with a limiting rib 323 that extends between the first and second limit walls 315, 316 of the first annular sleeve 312 of the corresponding mounting seat 31, that has an angular width shorter than the angular distance between the first and second limit walls 315, 316, and that has first and second contact sides 324, 325 which cooperate with the first and second limit walls 315, 316 to limit range of angular rotation of the pivot seat 32 relative to the corresponding mounting seat 31.

The locking unit 33 is operable to lock the pivot seats 32 from rotation relative to the mounting seats 31 so that the backrest frame 35 can be maintained at a desired angle relative to the leg frame 1. In this embodiment, the locking unit 33 is operable using one hand, and includes a pair of slide members 331 (only one is visible), a pair of first biasing members 334 (only one is shown), and an actuator unit 335.

Each of the slide members 331 is mounted slidably on the backrest frame 35 and has one side adjacent to a corresponding mounting seat 31 and formed with a positioning groove 330. Each slide member 331 is movable on the backrest frame 35 from an engaging position (see FIG. 8), where the positioning groove 330 engages a selected one of the positioning components 313 on the corresponding mounting seat 31 to lock the backrest frame 35 at a desired angle relative to the leg frame 1, and a disengaging position, where the positioning groove 330 is disengaged from the positioning components 313 on the corresponding mounting seat 31 to permit adjustment of the angle of the backrest frame 35 relative to the leg frame 1. Each first biasing member 334 biases a corresponding slide member 331 to the engaging position. The actuator unit 335 is connected to the slide members 331, and is operable to drive movement of the slide members 331 from the engaging position to the disengaging position.

Figure 6:
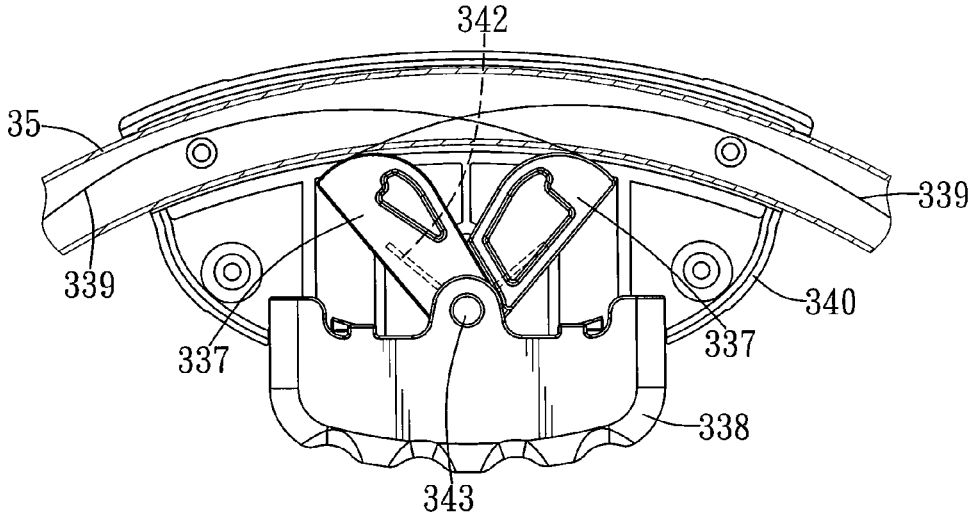
FIG. 6 is a fragmentary schematic sectional view of the actuator unit of the first preferred embodiment.
Figure 7:
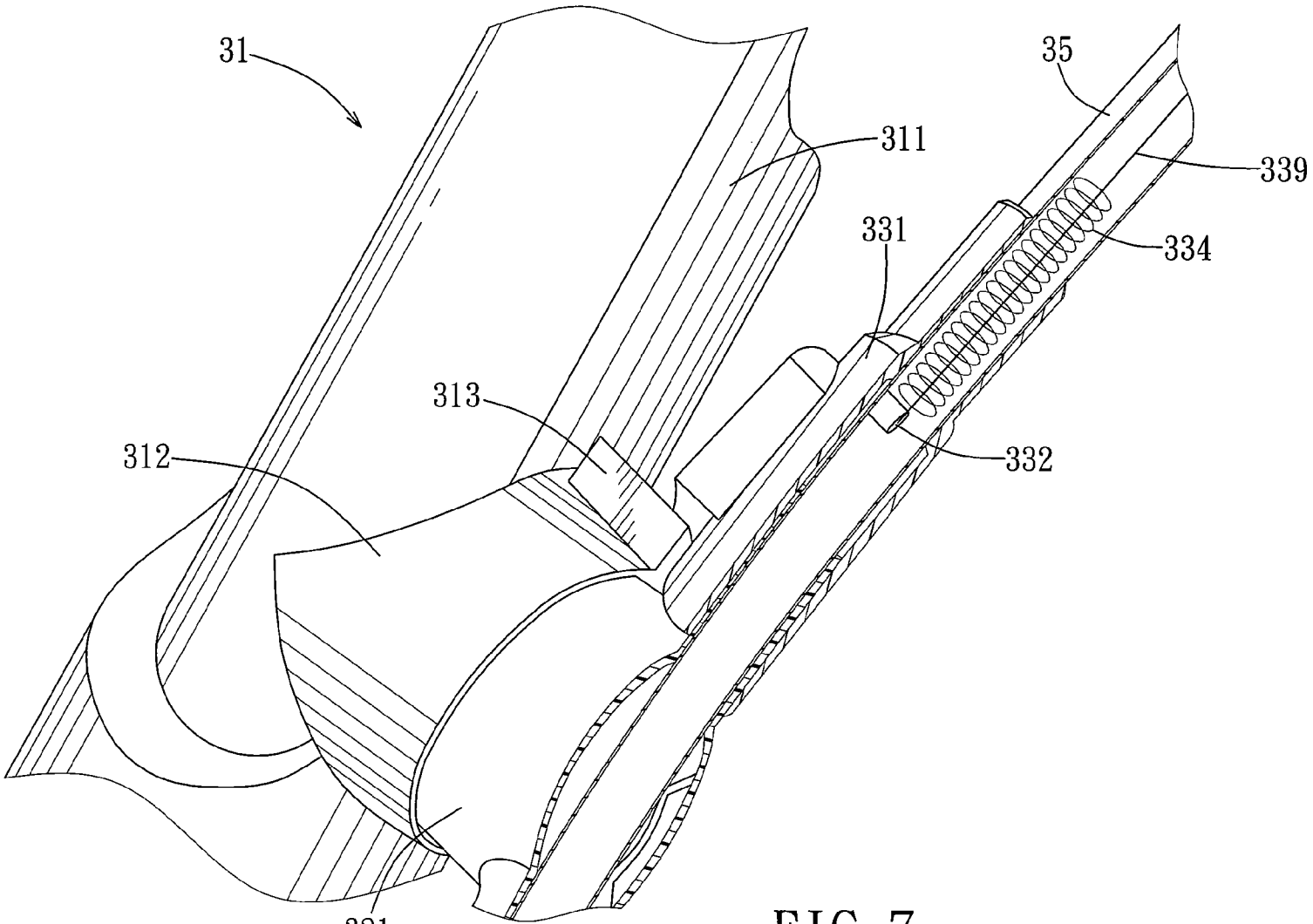
FIG. 7 is a fragmentary partly cutaway perspective view of the first preferred embodiment to illustrate a slide member on a backrest frame.

In this embodiment, the backrest frame 35 is hollow and is formed with a pair of elongate guide slots 351 (only one is shown) therealong. The locking unit 33 further includes a pair of guide pins 332 (only one is shown) and a pair of connecting components 339 (two are shown in FIG. 6). Each of the guide pins 332 passes through a corresponding one of the guide slots 351, is movable along the corresponding guide slot 351, and is connected to a corresponding slide member 331. Each of the connecting components 339 is disposed in the backrest frame 35 and has opposite ends connected to one of the guide pins 332 and the actuator unit 335, respectively. The locking unit 33 further includes a pair of limit pins 333, each of which extends through the backrest frame 35 and is disposed above a respective one of the guide slots 351. Each of the first biasing members 334 is disposed in the backrest frame 35, and has opposite ends abutting respectively against a corresponding limit pin 333 and a corresponding guide pin 332 such that each of the first biasing members 334 applies a biasing force to the corresponding guide pin 332 for biasing the corresponding slide member 331 to the engaging position. In this embodiment, each of the first biasing members 334 is a compression spring, and each of the connecting components 339 is a steel wire.

Figure 4:
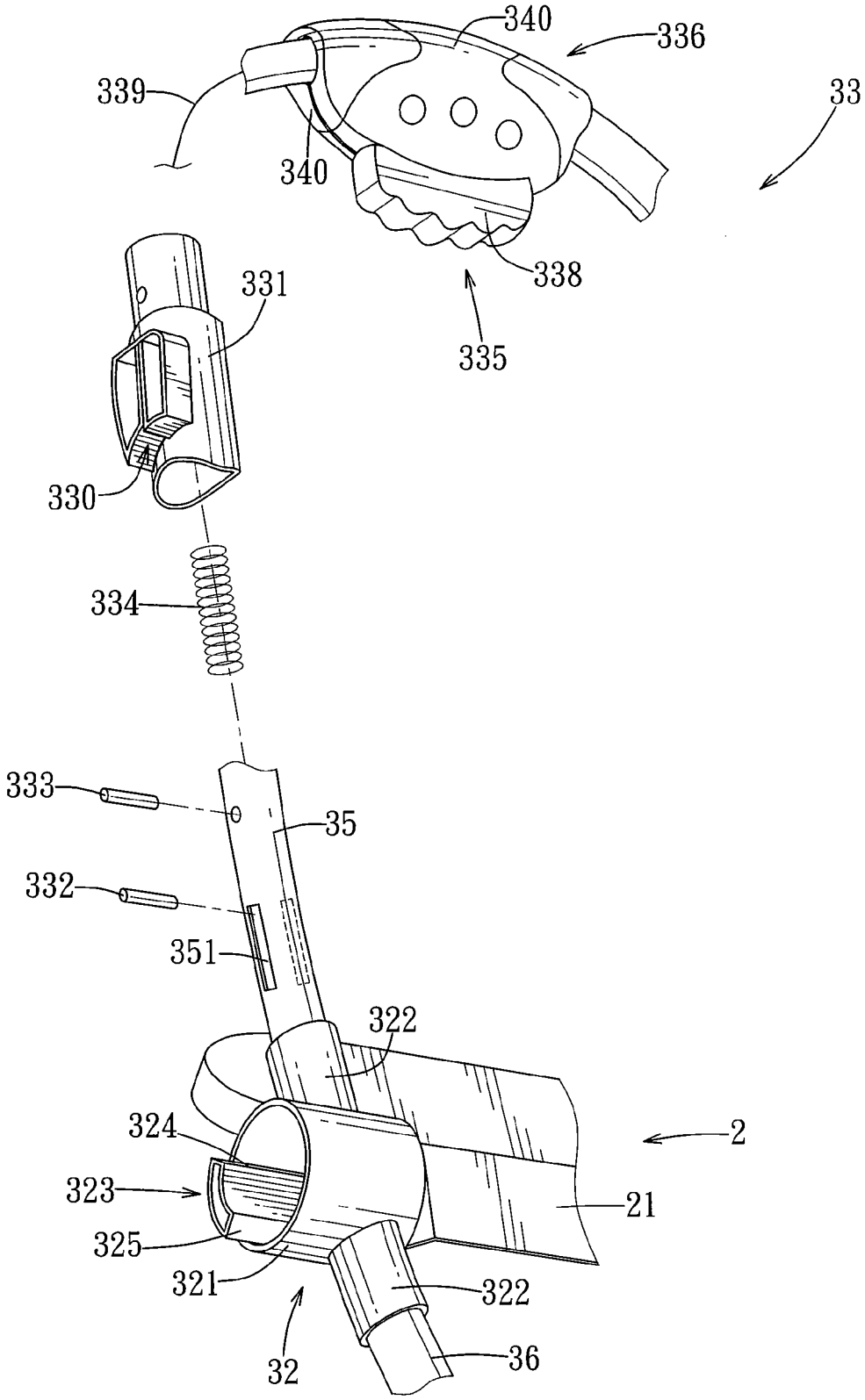
FIG. 4 is a fragmentary exploded perspective view to illustrate a locking unit of the first preferred embodiment.
Figure 5:
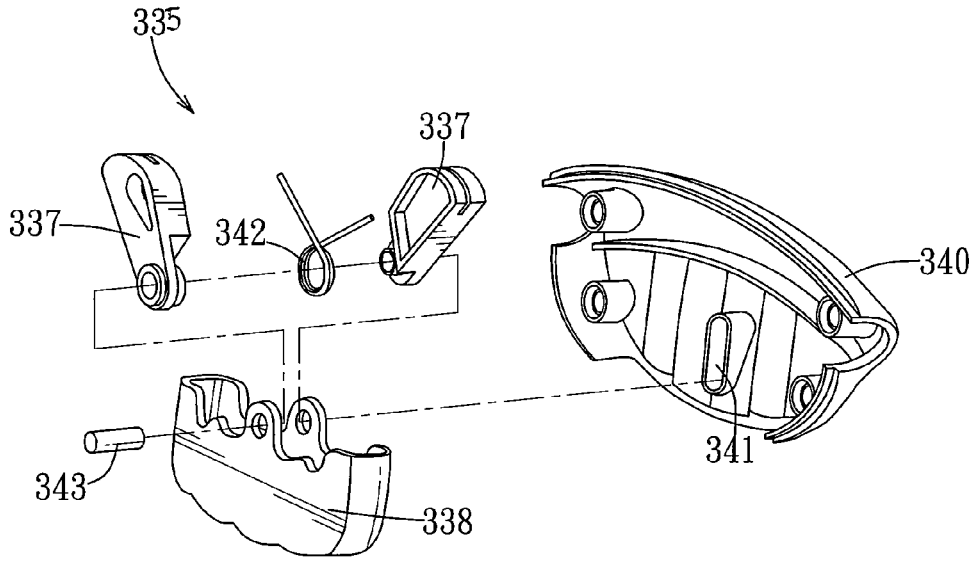
FIG. 5 is a fragmentary exploded perspective view to illustrate an actuator unit of the locking unit of the first preferred embodiment.

Referring to FIGS. 4, 5 and 6, the actuator unit 335 is a push-button-type mechanism that includes a casing 336, a pair of drive components 337, and a press button 338. The casing 336 includes two casing parts 340 mounted on a top end of the backrest frame 35. Each of the drive components 337 is disposed in the casing 336, is connected to a respective guide pin 332 via a respective connecting component 339, and is pivotable between initial and releasing positions (see FIGS. 6 and 9). The press button 338 is mounted movably on the casing 336, is connected to the drive components 337, is accessible externally of a lower side of the casing 336, and is operable to drive movement of the drive components 337 to the releasing position such that movement of the drive components 337 to the releasing position is transmitted to the guide pins 332 via the connecting components 339 so as to move the guide pins 332 along the guide slots 351, thereby moving the slide members 331 from the engaging position to the disengaging position.

In this embodiment, the casing parts 340 are formed with aligned vertical pin slots 341 (only one pin slot 341 is shown in FIG. 5). A pivot pin 343 extends through the pin slots 341, is movable along the pin slots 341, and passes through the press button 338 and lower ends of the drive components 337 such that the drive components 337 are pivotable in the casing 336 relative to the press button 338. The drive components 337 have top ends that abut slidably against the backrest frame 35. A second biasing member 342 is disposed between the drive components 337 and the press button 338. In this embodiment, the second biasing member 342 is a torsion spring that has a pair of spring arms abutting respectively against the drive components 337.

Figure 8:
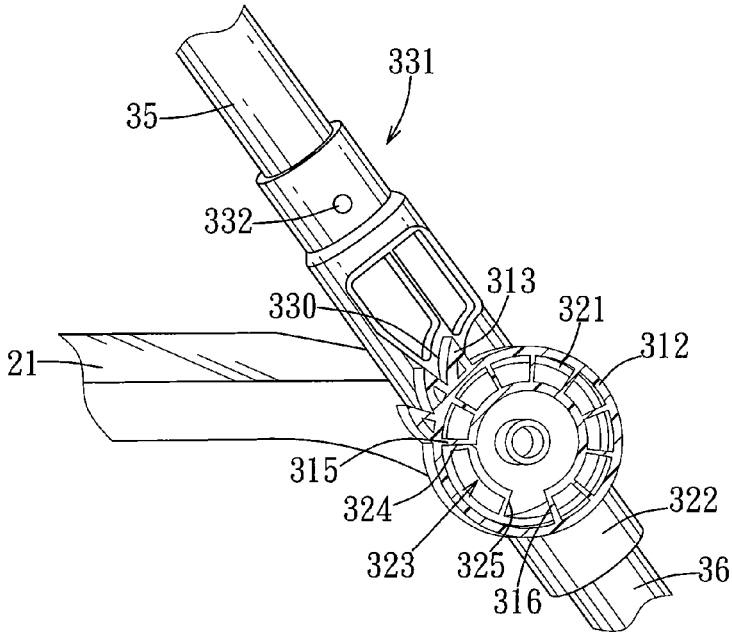
FIG. 8 is a fragmentary partly sectional schematic view taken along line 8-8 in FIG. 2 to illustrate how the backrest frame is locked relative to a leg frame.
Figure 9:
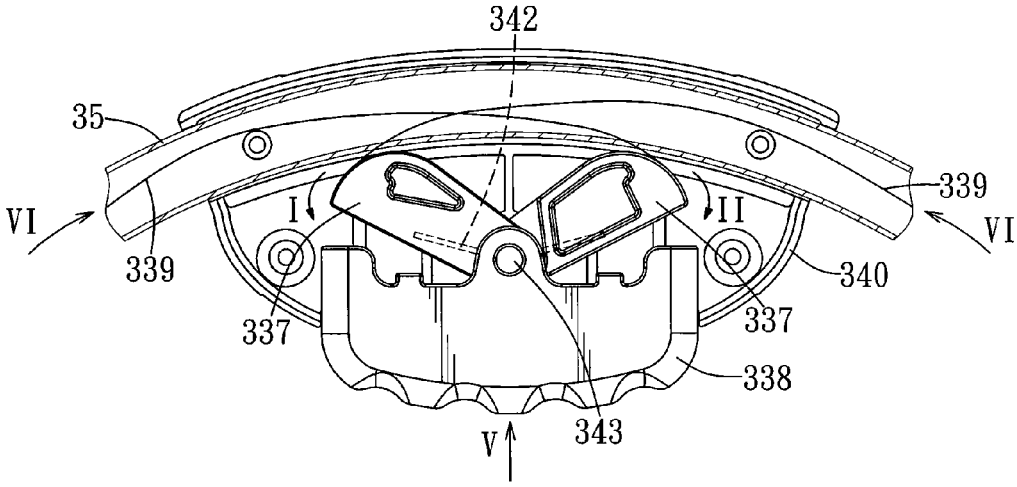
FIG. 9 is a view similar to FIG. 6, but illustrating the actuator unit when operated to unlock the backrest frame.

Referring to FIGS. 4, 7, 8 and 9, when the press button 338 is pressed in a direction (V) (see FIG. 9) to move the pivot pin 343 upwardly along the pin slots 341, the drive components 337 pivot in opposite directions (I, II) (see FIG. 9) and pull the connecting components 339 in directions (VI) (see FIG. 9)

toward each other. As a result, the connecting components 339 move the guide pins 332 along the guide slots 351 to thereby move the slide members 331 to the disengaging position. At this time, the pivot seats 32 may be pivoted relative to the mounting seats 31 to adjust the angle of the backrest frame 35 relative to the leg frame 1. After adjusting the backrest frame 35 to the desired angle, the press button 338 is released, the drive components 337 and the press button 338 are restored to their initial positions by virtue of the biasing action of the second biasing member 342, and the slide members 331 are restored to the engaging position by virtue of the biasing action of the first biasing members 334, thereby locking the pivot seats 32 against rotation relative to the mounting seats 31 so as to maintain the backrest frame 35 at the desired angle relative to the leg frame 1.

In this embodiment, the pivot seats 32 can be positioned at a selected one of first and second angular positions relative to the mounting seats 31. As shown in FIG. 8, when the pivot seat 32 is at the first angular position, the first contact side 324 of the limiting rib 323 abuts against the first limit wall 315 of the first annular sleeve 312 of the corresponding mounting seat 31, and the positioning groove 330 of the slide member 331 engages a first one of the positioning components 313 that is farthest from the first limit wall 315 in a clockwise direction. At this time, the seat member (not visible in FIG. 10) is at a generally horizontal state, and the backrest frame 35 forms a smaller first inclination angle with the leg frame 1. On the other hand, when the pivot seat 32 is at the second angular position, the second contact side 325 of the limiting rib 323 abuts against the second limit wall 316 of the first annular sleeve 312 of the corresponding mounting seat 31, and the positioning groove 330 of the slide member 331 engages a second one of the positioning components 313 that is closest to the first limit wall 315 in the clockwise direction. At this time, the seat member 21 inclines downwardly and rearwardly relative to the leg frame 1 (see FIG. 11), and the backrest frame 35 forms a larger second inclination angle with the leg frame 1. There is an intermediate third positioning component 313 between the aforesaid first and second positioning components 313 such that the backrest frame 35 is adjustable to form a selected one of three inclination angles with the leg frame 1.

Figure 10:
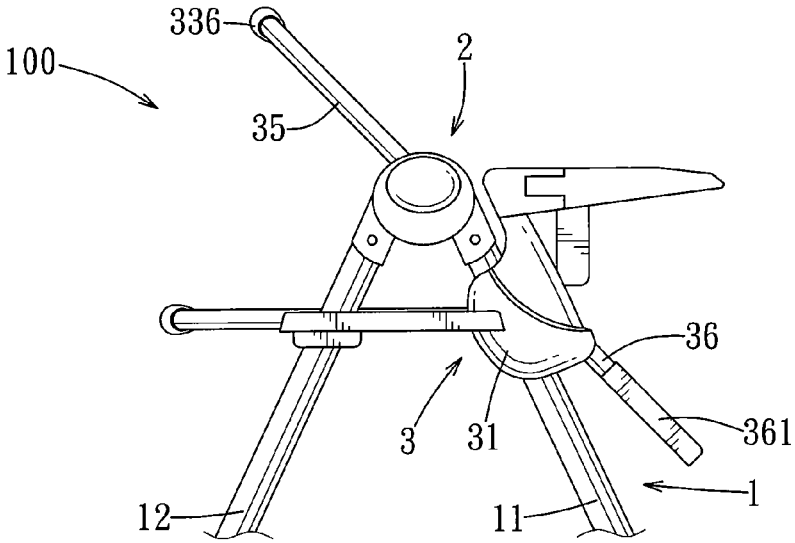
FIG. 10 is a schematic side view of the child highchair to illustrate a first inclination angle of the backrest frame relative to the leg frame.
Figure 11:
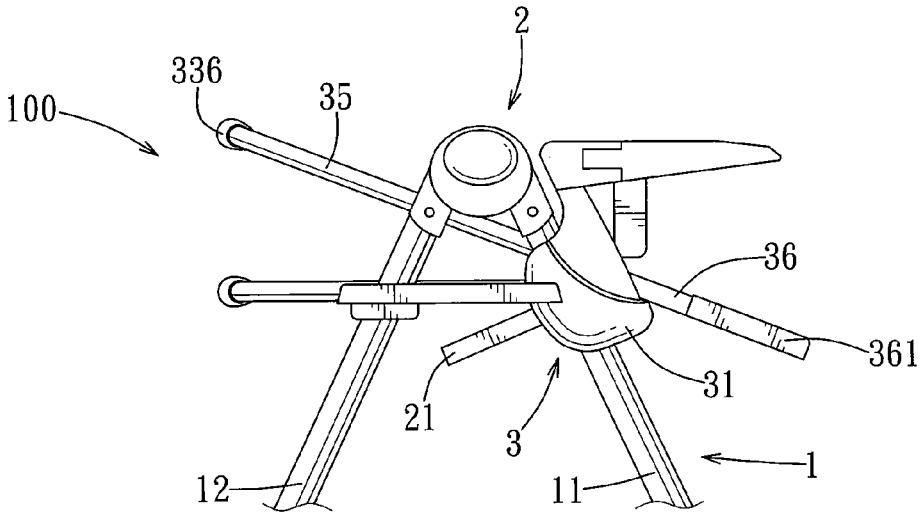
FIG. 11 is a schematic side view of the child highchair to illustrate a second inclination angle of the backrest frame relative to the leg frame.

Moreover, since the backrest frame 35 and the footrest frame 36 are connected to the connecting sleeves 322 of the pivot seats 32 in this embodiment, and since the second annular sleeves 321 of the pivot seats 32 are mounted on the lateral edges of the seat member 21, angular adjustment of the backrest frame 35 also results in simultaneous adjustment of the inclination of the footrest frame 36 and the seat member 21 relative to the leg frame 1 so that the position of a footrest member 361 (see FIGS. 1 and 2) on the footrest frame 36 is appropriately adjusted as well (as best shown in FIGS. 10 and 11).

Figure 12:
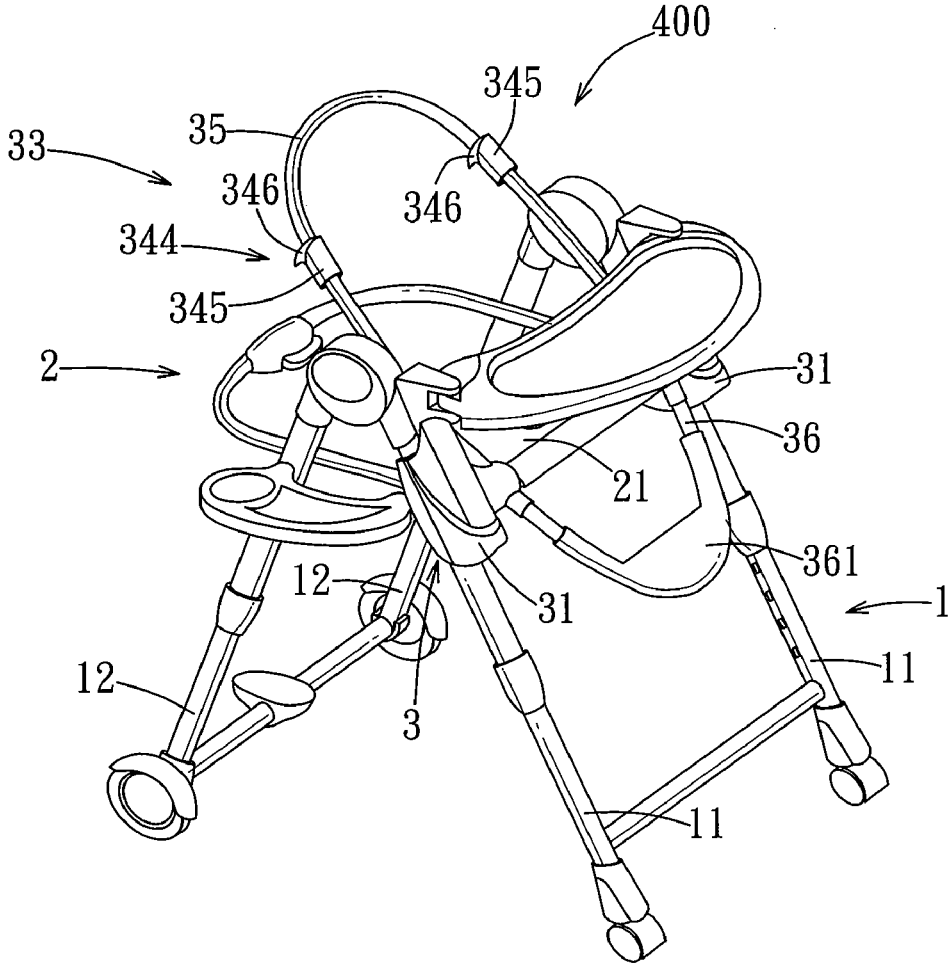
FIG. 12 is an assembled perspective view of a child highchair that incorporates the second preferred embodiment of an angle-adjustable backrest device according to the present invention.
Figure 13:
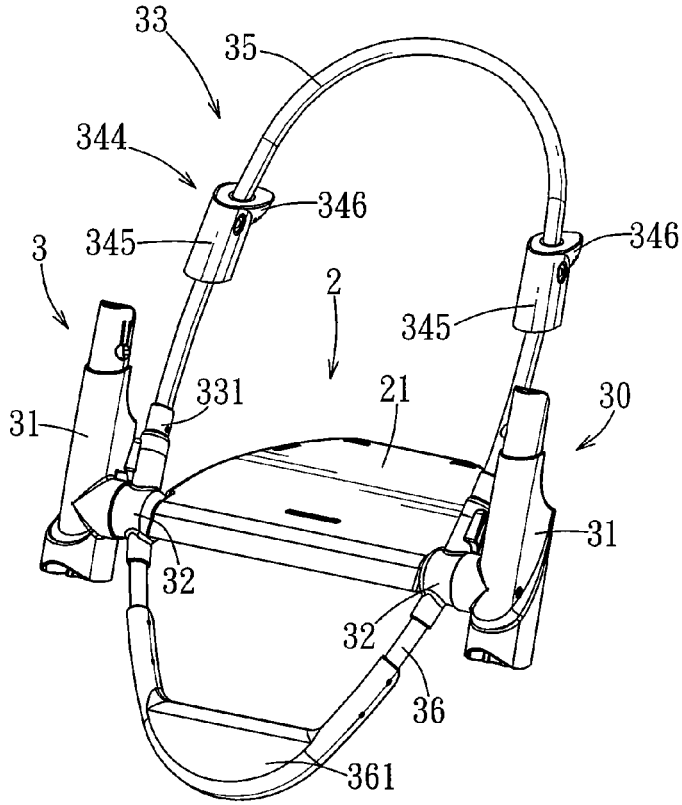
FIG. 13 is an assembled perspective view of the second preferred embodiment.
Figure 14:
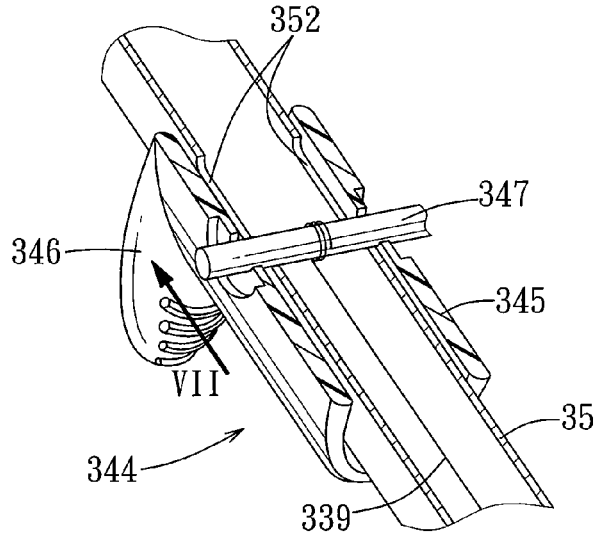
FIG. 14 is a fragmentary partly cutaway perspective view to illustrate an actuator unit of the second preferred embodiment.

FIGS. 12 to 14 illustrate a child highchair 400 that incorporates the second preferred embodiment of the angle-adjustable backrest device 3 according to this invention. The second preferred embodiment differs from the first preferred embodiment primarily in the construction of the actuator unit 344 of the locking unit 33 of the angle-adjusting device 30.

In this embodiment, the backrest frame 35 is further formed with a pair of elongated guide holes 352 (only one is shown), each of which is disposed above a respective one of the guide slots 351 (see FIG. 4). The actuator unit 344 includes a pair of pull members 345, each of which is in the form of a sleeve that is mounted slidably on the backrest frame 35 and that is formed with an operating part 346, and a pair of rivets 347, each of which passes through a respective one of the guide holes 352, is movable along the respective guide hole 352, and is connected to a respective one of the pull members 345 and a respective one of the connecting components 339.

The rivets 347 abut against bottom ends of the guide holes 352 when the slide members 331 are at the engaging position. When the pull members 345 are operated to move along the backrest frame 35 in a direction (VII) as shown in FIG. 14 for moving the guide pins 332 (see FIG. 4) along the guide slots 351 (see FIG. 4) via the rivets 347 and the connecting components 339, the slide members 331 are moved accordingly from the engaging position to the disengaging position to permit angular adjustment of the backrest frame 35 relative to the leg frame 1.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An angle-adjustable backrest device for a chair that includes a leg frame and a seat connected to the leg frame, said angle-adjustable backrest device comprising:

a backrest frame; and an angle-adjusting device operable for connecting said backrest frame to the chair and for adjusting an angular position of the backrest frame relative to the leg frame, said angle-adjusting device including a mounting seat operable for mounting on the leg frame, the mounting seat having an inner side wall provided with a plurality of positioning components, a pivot seat operable for mounting on the seat, the pivot seat being connected to said backrest frame and pivoted to said inner side wall of said mounting seat, the adjustment of the angular position of the backrest frame relative to the leg frame resulting in rotation of the pivot seat relative to the mounting seat causing a simultaneous angular movement of the seat relative to the leg frame, and a locking unit including a slide member mounted slidably on said backrest frame, the slide member having one side formed with a positioning groove, said slide member being movable on said backrest frame from an engaging position, where said positioning groove engages a selected one of said positioning components on said mounting seat to lock said backrest frame at a desired angle relative to the leg frame, and a disengaging position, where said positioning groove is disengaged from said positioning components on said mounting seat to permit adjustment of the angle of said backrest frame relative to the leg frame, a first biasing member for biasing said slide member to the engaging position, and an actuator unit connected to said slide member, the actuator unit being operable to drive movement of said slide member from the engaging position to the disengaging position.

2. The angle-adjustable backrest device as claimed in claim 1, wherein said backrest frame is hollow and is formed with an elongate guide slot therealong, said locking unit further includes a guide pin that passes through said guide slot, the guide pin being movable along said guide slot, and the guide pin being connected to said slide member, the locking unit further including a connecting component that is disposed in said backrest frame, the connecting component being connected to said guide pin and said actuator unit, and said first biasing member applies a biasing force to said guide pin for biasing said slide member to the engaging position.

3. The angle-adjustable backrest device as claimed in claim 2, wherein said first biasing member is a compression spring.

4. The angle-adjustable backrest device as claimed in claim 2, wherein said connecting component is a steel wire.

5. The angle-adjustable backrest device as claimed in claim 2, wherein said backrest frame is further formed with an elongate guide hole above said guide slot, and said actuator unit includes a pull member that is mounted slidably on said backrest frame, and a rivet that passes through said guide hole, that is movable along said guide hole, and that is connected to said pull member and said connecting component, said pull member being operable to move along said backrest frame for moving said slide member from the engaging position to the disengaging position.

6. The angle-adjustable backrest device as claimed in claim 1, further comprising a footrest frame disposed below said backrest frame, the footrest frame being connected to said pivot seat, and the footrest frame being pivotable together with said backrest frame and said pivot seat relative to said mounting seat.

7. The angle-adjustable backrest device as claimed in claim 1, wherein:

said locking unit includes a connecting component that has one end connected to said slide member and an opposite end that is connected to said actuator unit; and said actuator unit includes a pull member that is mounted slidably on said backrest frame, and a rivet that is movable along said backrest frame and that is connected to said pull member and said opposite end of said connecting component, said pull member being operable to move along said backrest frame for moving said slide member from the engaging position to the disengaging position.

8. The angle-adjustable backrest device as claimed in claim 1, wherein said slide member is separated from said pivot seat when said slide member is disposed at the disengaging position.

9. An angle-adjustable backrest device for a chair that includes a leg frame and a seat connected to the leg frame, said angle-adjustable backrest device comprising:

a backrest frame; and an angle-adjusting device operable for connecting said backrest frame to the chair, said angle-adjusting device including a mounting seat operable for mounting on the leg frame, the mounting seat having an inner side wall provided with a plurality of positioning components, said mounting seat including a first annular sleeve at said inner side wall, a pivot seat operable for mounting on the seat, the pivot seat being connected to said backrest frame and pivoted to said inner side wall of said mounting seat, said pivot seat including a second annular sleeve having a diameter smaller than that of said first annular sleeve, said first annular sleeve being sleeved rotatably on said second annular sleeve, and a locking unit including a slide member mounted slidably on said backrest frame, the slide member having one side formed with a positioning groove, said slide member being movable on said backrest frame from an engaging position, where said positioning groove engages a selected one of said positioning components on said mounting seat to lock said backrest frame at a desired angle relative to the leg frame, and a disengaging position, where said positioning groove is disengaged from said positioning components on said mounting seat to permit adjustment of the angle of said backrest frame relative to the leg frame, a first biasing member for biasing said slide member to the engaging position, and an actuator unit connected to said slide member, the actuator unit being operable to drive movement of said slide member from the engaging position to the disengaging position.

10. The angle-adjustable backrest device as claimed in claim 9, wherein said positioning components are formed as teeth that project in radial outward directions from said first annular sleeve.

11. The angle-adjustable backrest device as claimed in claim 9, wherein said first annular sleeve of said mounting seat has an inner sleeve surface formed with first and second limit walls that extend in radial inward directions, the first and second limit walls being spaced apart from each other by an angular distance, said second annular sleeve of said pivot seat having an inner sleeve surface provided with a limiting rib that extends between said first and second limit walls, the limiting rib having an angular width shorter than the angular distance between said first and second limit walls, and the limiting rib cooperating with said first and second limit walls to limit range of angular rotation of said pivot seat relative to said mounting seat.

12. An angle-adjustable backrest device as claimed in claim 2, wherein said actuator unit includes: a casing mounted on said backrest frame; a drive component disposed in said casing, the drive component being connected to said guide pin via said connecting component, and the drive component being pivotable between initial and releasing positions; and a press button mounted movably on said casing, the press button being connected to said drive component, and the press button being operable to drive movement of said drive component from the initial position to the releasing position for moving said slide member from the engaging position to the disengaging position.

13. The angle-adjustable backrest device as claimed in claim 12, wherein said actuator unit further includes a second biasing member disposed between said drive component and said press button.

14. The angle-adjustable backrest device as claimed in claim 13, wherein said second biasing member is a torsion spring.

15. An angle-adjustable backrest device for a chair that includes a leg frame and a seat connected to the leg frame, said angle-adjustable backrest device comprising:

a backrest frame; and an angle-adjusting device operable for connecting said backrest frame to the chair, said angle-adjusting device including a mounting seat operable for mounting on the leg frame, the mounting seat having an inner side wall provided with a plurality of positioning components, a pivot seat operable for mounting on the seat, the pivot seat being connected to said backrest frame and pivoted to said inner side wall of said mounting seat, and a locking unit including a slide member mounted slidably on said backrest frame, the slide member having one side formed with a positioning groove, said slide member being movable on said backrest frame from an engaging position, where said positioning groove engages a selected one of said positioning components on said mounting seat to lock said backrest frame at a desired angle relative to the leg frame, and a disengaging position, where said positioning groove is disengaged from said positioning components on said mounting seat to permit adjustment of the angle of said backrest frame relative to the leg frame, a first biasing member for biasing said slide member to the engaging position, a connecting component that has one end connected to said slide member and a second end opposite to the one end an actuator unit connected to said slide member, the actuator unit being operable to drive movement of said slide member from the engaging position to the disengaging position, the second end of the connecting component being connected to the actuator unit, said actuator unit including a casing mounted on said backrest frame, a drive component disposed in said casing, the drive component being connected to said opposite end of said connecting component, and pivotable between initial and releasing positions, and a press button mounted movably on said casing, connected to said drive component, and operable to drive movement of said drive component from the initial position to the releasing position for moving said slide member from the engaging position to the disengaging position.

16. The angle-adjustable backrest device as claimed in claim 15, wherein said casing is formed with a pin slot, said actuator unit further including a pivot pin that extends through and that is movable along said pin slot, and the pivot pin connecting pivotally said drive component to said press button.

17. A chair, comprising:

a leg frame;

a seat connected to the leg frame; and an angle-adjustable backrest device that includes a backrest frame; and an angle-adjusting device operable for connecting said backrest frame to the chair and for adjusting an angular position of the backrest frame relative to the leg frame, said angle-adjusting device including a mounting seat operable for mounting on the leg frame, the mounting seat having an inner side wall provided with a plurality of positioning components, a pivot seat operable for mounting on the seat, the pivot seat being connected to said backrest frame and pivoted to said inner side wall of said mounting seat, the adjustment of the angular position of the backrest frame relative to the leg frame resulting in rotation of the pivot seat relative to the mounting seat causing a simultaneous angular movement of the seat relative to the leg frame, and a locking unit including a slide member mounted slidably on said backrest frame, the slide member having one side formed with a positioning groove, said slide member being movable on said backrest frame from an engaging position, where said positioning groove engages a selected one of said positioning components on said mounting seat to lock said backrest frame at a desired angle relative to the leg frame, and a disengaging position, where said positioning groove is disengaged from said positioning components on said mounting seat to permit adjustment of the angle of said backrest frame relative to the leg frame, a first biasing member for biasing said slide member to the engaging position, and an actuator unit connected to said slide member, the actuator unit being operable to drive movement of said slide member from the engaging position to the disengaging position.

18. The chair as claimed in claim 17, wherein said slide member is separated from said pivot seat when said slide member is disposed at the disengaging position.

* * * * *